US005161716A

United States Patent [19]

Knickerbocker

[11] Patent Number: 5,161,716

[45] Date of Patent: * Nov. 10, 1992

[54] DISPENSER HAVING CHILD-RESISTANT NOZZLE ASSEMBLY

[75] Inventor: Michael G. Knickerbocker, Upland, Calif.

[73] Assignee: Calmar Inc., City of Industry, Calif.

[ * ] Notice: The portion of the term of this patent subsequent to Sep. 24, 2008 has been disclaimed.

[21] Appl. No.: 691,796

[22] Filed: Apr. 26, 1991

Related U.S. Application Data

[63] Continuation-in-part of Ser. No. 552,067, Jul. 13, 1990, Pat. No. 5,050,779.

[51] Int. Cl.[5] ..... B67B 5/00

[52] U.S. Cl. ..... 222/153; 239/333

[58] Field of Search ..... 222/153, 321, 341, 380, 222/383, 384, 385; 239/333, 394

[56] References Cited

U.S. PATENT DOCUMENTS

| | | | |
|---|---|---|---|
| 4,204,614 | 5/1980 | Reeve | 222/153 |
| 4,257,561 | 3/1981 | McKinney | 239/581.2 |
| 4,346,821 | 8/1982 | Wesner et al. | 222/321 X |
| 4,506,805 | 3/1985 | Marcon | 222/321 X |
| 4,516,695 | 5/1985 | Garneau | 222/380 X |
| 4,706,888 | 11/1987 | Dobbs | 239/478 |

*Primary Examiner*—Andres Kashnikow
*Assistant Examiner*—Anthoula Pomrening
*Attorney, Agent, or Firm*—Watson, Cole, Grindle & Watson

[57] ABSTRACT

A child-resistant nozzle assembly for a fluid dispenser has an external anti-rotative stop, and the dispenser body has a spring-biased tab abutting the stop in an off position of the nozzle at which the discharge passage is closed for locking the cap against rotation from such off position. The tab is flexed outwardly away from the stop to permit cap rotation for opening the spray discharge.

3 Claims, 2 Drawing Sheets

DISPENSER HAVING CHILD-RESISTANT NOZZLE ASSEMBLY

RELATED APPLICATION

This application is a continuation in part of U.S. Ser. No. 552,067, filed Jul. 13, 1990 now U.S. Pat. No. 5,050,779.

BACKGROUND OF THE INVENTION

This invention relates generally to a manually actuated fluid dispenser, and more particularly to a rotatable nozzle assembly for such dispenser capable of being easily and effectively locked in its off position against rotation from such position, thereby rendering the nozzle child-resistant.

Child-resistant nozzle assemblies for manually actuated fluid dispensers have been devised, but are not without their limitations. For example, U.S. Pat. No. 4,257,561 discloses a nozzle cap having a slot in its upstream end, a flexible lug on the dispenser body being received within the slot to prevent the nozzle from turning.

The nozzle cap of U.S. Pat. No. 4,204,614 has an internal shoulder engageable by a spring biased tab on the dispenser body to prevent rotation of the cap from its off position.

In both prior art assemblies, the lug or tab is manually depressable for unlocking the cap to permit cap rotation to facilitate fluid discharge. Such a depressable lug or tab is, however, awkward and oftentimes difficult to operate even by an adult. The internal clearance available to permit depression of the tab or lug limits the flexible length of the tab or lug, which thereby stiffens the spring and renders it more difficult to depress. A raised position has been provided on the tab or lug for increasing its mechanical advantage upon depression, although such has been met with limited success Thus, adults without the necessary strength or dexterity have much difficulty in depressing the tab or lug, thereby defeating its purpose.

Moreover, some type of indicia must be provided for instructing the user to press the tab or lug to permit cap rotation for dispensing, since it may be not so obvious to the operator without such instructions. However, the lack of space in the vicinity of the lug or tab limits the application of adequate instructions.

Another child-resistant nozzle is disclosed in U.S. Pat. No. 4,516,695 as having a finger actuated pull tab for disengaging a lock tab from an internal recess located within the nozzle cap skirt. However, the tab is required to be hinge mounted on a nose bushing to which the nozzle is coupled thereby rendering the child-resistant nozzle difficult and expensive to mold and assemble. Moreover, the pull tab is not readily accessible and easy to manipulate.

SUMMARY OF THE INVENTION

It is therefore an object of the present invention to provide a child-resistant nozzle assembly for a manually actuated fluid dispenser which avoids the aforementioned drawbacks of the prior art, and which is highly effective in locking the nozzle cap in its off position, while being easier to operate, more economical to produce, and more efficient.

The anti-rotative, child-resistant nozzle assembly according to the invention is adapted for both a nozzle cap of generally cylindrical configuration and a nozzle cap of rectangular cross-section presenting flat outer side surfaces For either style, the nozzle cap has an external anti-rotative stop, and the dispenser body to which the cap is fitted has a spring biased tab in abutting engagement with such stop in an off position of the cap at which cooperating valve elements acting between the discharge passage and the cap close the discharge. The tab is capable of being manually flexed away from the stop to permit rotation of the cap to its on position through an open orifice.

For a generally cylindrically nozzle cap, an outwardly open groove provided in the outer cylindrical surface defines the stop. The tab is received in the groove and has a side edge in abutting engagement with the groove sidewall in the off Position. And, the round nozzle cap is typically thread coupled to the nozzle end of the dispenser body.

The cap may have an external recess opening into the tab to provide manual access to the tab to facilitate manual outward movement thereof. Or, the tab may extend beyond the open groove so as to define a finger engaging portion to facilitate the manual outward movement of the tab.

For the other style cap of rectangular cross-section, one of the flat faces thereof defines the stop against which the flat undersurface of the tab abuts in the off position. The tab extends beyond the front wall of the nozzle cap to facilitate manual disengagement of its flat undersurface from the flat face of the cap. And, the cap is snap-fitted on the nozzle end of the dispenser body.

For both styles of nozzle cap, the spring tab can be located on an upper wall or on a side wall of the dispenser body, and the tab is easily flexed outwardly by the operator without interference with any element of the dispenser body or cap.

Other objects, advantages and novel features of the invention will become more apparent from the following detailed description of the invention when taken in conjunction with the accompanying drawings.

DETAILED DESCRIPTION OF THE INVENTION

Figure 1:
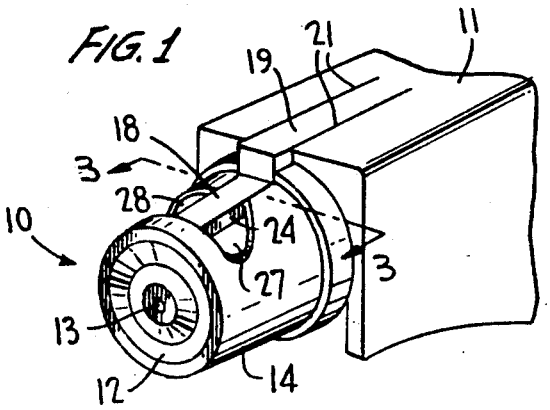
FIG. 1 is a perspective view of a round nozzle cap shown mounted on a dispenser body and locked in place against rotation by a spring tab according to the invention.

Turning now to the drawings wherein like reference characters refer to like and corresponding parts throughout the several views, a nozzle assembly generally designated 10 in FIG. 1 is coupled to a dispenser body 11 of a manually operated pump dispenser of known variety. An example of such pump dispenser is shown in U.S. Pat. No. 4,204,614, the disclosure of which being specifically incorporated herein by reference. Of course, the invention is also adapted for use on aerosol dispensers or other pressurized dispensers.

The nozzle assembly comprises a generally cylindrical, hollow nozzle cap having an end wall 12 containing a coaxial discharge orifice 13, and a substantially cylindrical skirt or side wall 14 internally threaded for threaded engagement with hollow nozle end 15 of the dispenser body. The dispenser body has a discharge passage 16 which extends through its nozzle end and which terminates in the discharge orifice.

As shown in more detail in U.S. Pat. No. 4,204,614, the dispenser includes a needle valve 17 which, in the off position of the nozzle shown in FIG. 2, plugs into the discharge orifice of the cap. Upon unthreading the cap, the discharge orifice is open to effect various degrees of spray discharge, as well known in the art.

Figure 3:
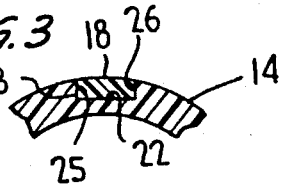
FIG. 3 is a detail cross-sectional view taken substantially along the line 3—3 of FIG. 1.

In accordance with the invention, the dispenser body has a spring biased locking tab 18 formed as an extension of a plate spring 19 defined by a pair of spaced slits 21 in the dispenser body. In the off position of the nozzle cap at which valve 17 closes the discharge passage, tab 18 is received in an open groove 22 extending parallel to the central axis of the cap. As shown in FIGS. 1 and 3, the tab nests within the groove, and opposing side edges 23,24 abut against side walls 25,26 of the groove. Side wall 26 defines a stop against which side wall 24 of the tab abuts for locking the cap against rotation (counterclockwise in FIG. 1) from its off position of FIGS. 1 and 2.

Figure 2:
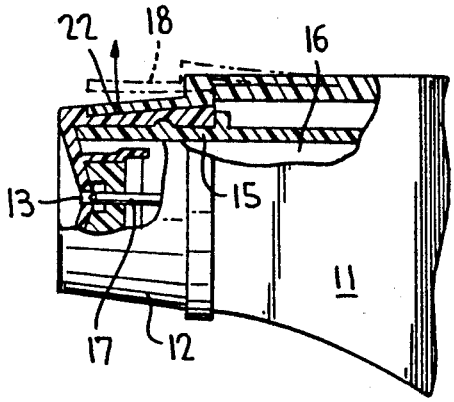
FIG. 2 is a side elevational view, partly in section, of the assembly of FIG. 1.

For opening the discharge, the cap must be unthreaded from its off position by simply manually lifting tab 18 to its phantom outline position of FIG. 2 so as to disengage the tab from groove 22, whereupon side edge 24 is disengaged from stop 26. To facilitate manual access to the tab, the nozzle is provided with recesses 27,28 opening into opposing side edges 23 and 24 of the tab.

In operation, the user simply lifts up on tab 18 with his thumb and forefinger of one hand and unthreads the cap with fingers of the other hand for opening the discharge orifice in readiness for a spray operation. Because of the difficulty in carrying out such a two-handed operation by a child, the aforedescribed nozzle assembly is rendered child-resistant.

Figure 4:
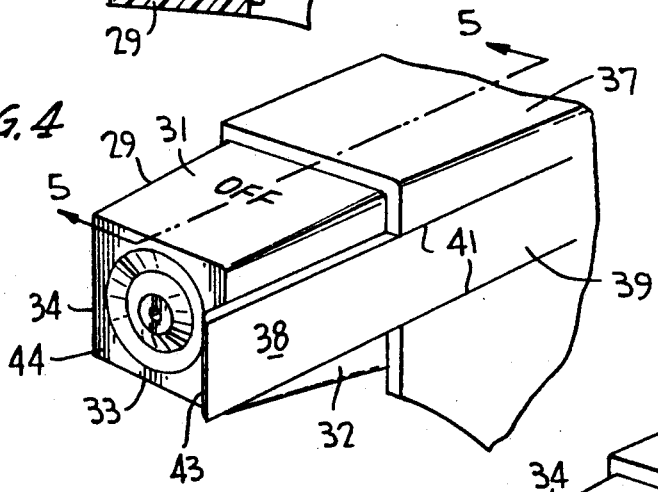
FIG. 4 is a perspective view of a nozzle cap of rectangular cross-section mounted on a dispenser body having a spring tab preventing cap rotation according to the invention.
Figure 6:
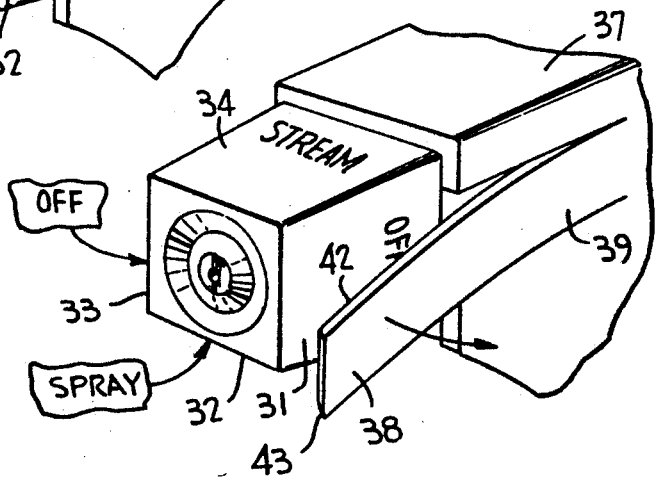
FIG. 6 is a view similar to FIG. 4, showing the spring tab flexed outwardly, permitting cap rotation to one of its on positions.

FIGS. 4 and 6 illustrate another style nozzle cap 29 which is rendered child-resistant according to the invention. The cap is rotatable about its central axis, without axial movement as in FIGS. 1 and 2, between spray-off and stream-off positions. The structural details of such nozzle assembly are disclosed in U.S. Pat. No. 4,706,888, the disclosure of which being specifically incorporated herein by reference.

Figure 5:
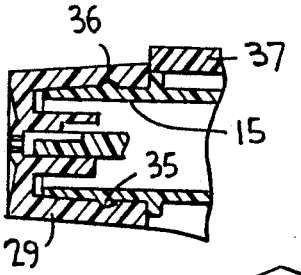
FIG. 5 is a sectional view taken substantially along the line 5—5 of FIG. 4.

The nozzle cap is rectangular in cross-section, having flat faces 31, 32, 33 and 34. Opposing faces 31 and 33 have OFF markings, face 32 has a SPRAY marking, and face 34 has, a STREAM marking. In the two off positions, faces 31 and 33 respectively face upwardly, and the discharge is closed in either of these off positions. Cap 29 has an internal groove 35 which receives an annular rib 36 (FIG. 5) on nozzle end 15 of dispenser body 37 for snap-fitting the nozzle in place.

In accordance with the invention, a spring-biased tab 38 is integrally connected with a plate spring 39 on the dispenser body. The plate spring is defined by a pair of spaced slits 41. The tab has a flat undersurface 42 which abuts against flat face 32 in the FIG. 4 off position. Flat face 32, or face 34 if face 33 is uppermost, defines a stop against which the undersurface of the tab abuts to prevent rotation of the nozzle cap in either direction, thereby rendering it child-resistant.

Figure 7:
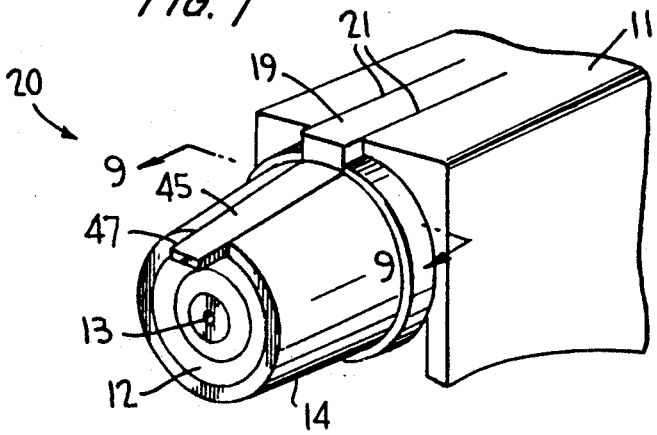
FIG. 7 is a perspective view of another round nozzle cap shown mounted on a dispenser body and locked in place according to another embodiment of the invention.
Figure 9:
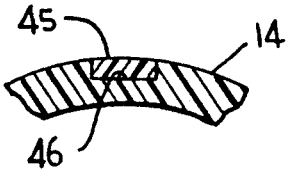
FIG. 9 is a detail cross-sectional view taken substantially along the line 9—9 of FIG. 7.
Figure 8:
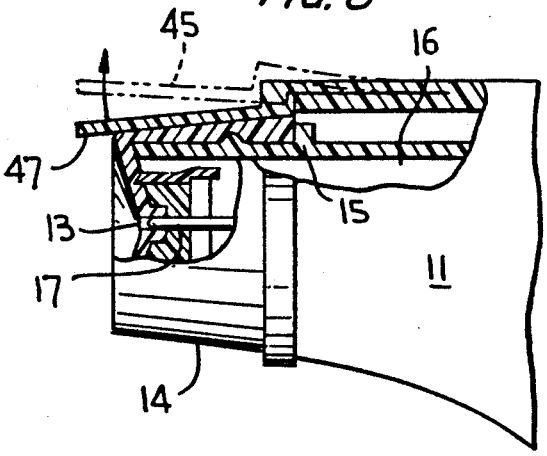
FIG. 8 is a side elevational view, partly in section, of the assembly of FIG. 7.

The free end 43 of the tab extends slightly beyond end wall 44 of the nozzle cap to provide access to the operator for simply flexing the tab outwardly as shown in FIG. 6 with the fingers of one hand for disengaging the tab from its confronting stop, so that the nozzle can be rotated in either direction by the other hand to its stream or spray position Nozzle assembly 20 shown in FIGS. 7 to 9 is similar to nozzle assembly 10 of FIG. 1 except for the type of spring locking tab utilized, and nozzle cap locking groove provided, locking the nozzle cap against rotation from its off position. Like parts between FIG. 1 and 7 are therefore represented by like reference numerals.

In accordance with the embodiment of FIGS. 7 to 9, the dispenser has a spring biased locking tab 45 formed as an extension of plate spring 19 defined by spaced slits 21 in the dispenser body. In the off position of the nozzle cap at which valve 17 closes the discharge passage, tab 45 is received in an open outer groove 46 extending along the entire length of the cap and parallel to the cap central axis which is coaxial with valve 17. Groove 46 defines an external anti-rotative stop locking the cap against rotation from its off position of FIGS. 7 and 8.

Tab 45 extends beyond front wall 12 of the cap to define a finger engaging portion 47 to facilitate manual outward flexing movement of the tab for disengagment from the stop to permit rotation of the cap to its on position.

In operation, the user simply pushes up on the finger engaging portion 47 for lifting the tab with one hand while unthreading the cap with the other hand for opening the discharge in readiness for a spray operation. Because of the difficulty in carrying out such a two-handed operation by a child, the aforedescribed nozzle assembly is rendered child-resistant.

Obviously, many modifications and variations of the present invention are made possible in the light of the above teachings. It is therefore to be understood that within the scope of the appended claims the invention may be practiced otherwise than as specifically described.

What is claimed is:

1. A fluid dispenser which includes a dispenser body having a nozzle end, said body having a discharge passage extending through said end, a child-resistant nozzle assembly comprising a nozzle cap in engagement with said nozzle end for rotation of said cap about a central axis thereof between off and on positions of said cap, said cap having a front wall containing a discharge orifice, cooperating valve means acting between said passage and said cap for closing and opening said passage respectively in said off and on positions of said cap, said cap having an outer wall containing an open groove which defines an anti-rotative stop, and said body having a spring biased tab in abutting engagement with said stop in said off position for locking said cap against rotation from said off Position, said tab being adapted for manual outward flexing movement for disengagement from said stop to permit rotation of said cap to said on position, and said tab extending beyond said front wall to define a finger engaging portion to facilitate the manual outward movement of said tab.

2. The dispenser according to claim 1, wherein thread means on said nozzle end and within said cap are provided for threaded engagement of cap and said nozzle end.

3. A fluid dispenser which includes a dispenser body having a nozzle end, said body having a discharge passage extending through said end, a child-resistant nozzle assembly comprising a nozzle cap in engagement with said nozzle end for rotation of said cap about a central axis thereof between off and on positions of said cap, cooperating valve means acting between said passage and said cap for closing and opening said passage respectively in said off and on positions of said cap, said cap having an outer groove extending along the entire length thereof parallel to said axis and defining an external anti-rotative stop, and said body having a spring biased tab parallel to said axis and in abutting engagement with said stop in said off position for locking said cap against rotation from said off position, said tab being adapted for manual outward flexing movement for disengagement from said stop to permit rotation of said cap to said on position, and said tab having a finger engaging portion extending beyond said groove to facilitate the manual outward movement of said tab.

* * * * *